US010616986B2

(12) United States Patent
Miller et al.

(10) Patent No.: US 10,616,986 B2
(45) **Date of Patent: *Apr. 7, 2020**

(54) BIPOLAR VOLTAGE MULTIPLIER WITH REDUCED VOLTAGE GRADIENT

(71) Applicant: Moxtek, Inc., Orem, UT (US)

(72) Inventors: Eric Miller, Provo, UT (US); Tyler Washburn, Pleasant Grove, UT (US); Roland Creed, South Jordan, UT (US)

(73) Assignee: Moxtek, Inc., Orem, UT (US)

( * ) Notice: Subject to any disclaimer, the term of this patent is extended or adjusted under 35 U.S.C. 154(b) by 31 days.

This patent is subject to a terminal disclaimer.

(21) Appl. No.: 16/180,596

(22) Filed: Nov. 5, 2018

(65) Prior Publication Data

US 2019/0150258 A1 May 16, 2019

Related U.S. Application Data

(63) Continuation-in-part of application No. 16/142,334, filed on Sep. 26, 2018, now Pat. No. 10,499,484.

(60) Provisional application No. 62/587,147, filed on Nov. 16, 2017.

(51) Int. Cl.
*H05G 1/10* (2006.01)

(52) U.S. Cl.
CPC ..... *H05G 1/10* (2013.01)

(58) Field of Classification Search
CPC ..... H05G 1/10; H05G 1/06; H01J 35/025; H02M 7/106
USPC ..... 378/101, 104
See application file for complete search history.

(56) References Cited

U.S. PATENT DOCUMENTS

| | | | | |
|---|---|---|---|---|
| 4,720,844 | A * | 1/1988 | Bougle | H05G 1/10 363/61 |
| 4,995,069 | A | 2/1991 | Tanaka | |
| 9,369,060 | B2 | 6/2016 | Mao et al. | |
| 10,499,484 | B2 * | 12/2019 | Miller | H01J 35/025 |
| 2009/0010393 | A1 | 1/2009 | Klinkowstein et al. | |
| 2015/0055747 | A1 | 2/2015 | Simon et al. | |
| 2015/0139391 | A1 | 5/2015 | Luerkens | |
| 2017/0251545 | A1 | 8/2017 | Klinkowstein et al. | |

FOREIGN PATENT DOCUMENTS

WO WO 2013131628 A1 9/2013

OTHER PUBLICATIONS

Wang, Jianing et al., "Modeling of Parasitic Elements in High Voltage Multiplier Modules," Electrical Power Processing (EPP) Group, Electrical Sustainable Energy Department Delft University of Technology, Copyright © 2014.

* cited by examiner

*Primary Examiner* — Courtney D Thomas
(74) *Attorney, Agent, or Firm* — Thorpe, North & Western, LLP

(57) ABSTRACT

An x-ray source can have a reduced voltage gradient and a consistent voltage gradient, thus allowing less insulation, reduced arcing failure, or both. The x-ray source can comprise a bipolar voltage multiplier and an x-ray tube. The bipolar voltage multiplier can include a negative voltage multiplier and a positive voltage multiplier. An axis extending from an input voltage of the negative voltage multiplier to a negative output bias voltage defines a negative axis. An axis extending from an input voltage of the positive voltage multiplier to a positive output bias voltage defines a positive axis. An angle A1 between the negative axis and the positive axis can be selected for optimal voltage gradient.

20 Claims, 7 Drawing Sheets

BIPOLAR VOLTAGE MULTIPLIER WITH REDUCED VOLTAGE GRADIENT

CLAIM OF PRIORITY

This is a continuation-in-part of U.S. patent application Ser. No. 16/142,334, filed on Sep. 26, 2018; which claims priority to U.S. Provisional Patent Application No. 62/587,147, filed on Nov. 16, 2017; which are incorporated herein by reference.

FIELD OF THE INVENTION

The present application is related generally to x-ray sources.

BACKGROUND

Voltage multipliers can generate many kilovolts of voltage differential. In an x-ray source, this voltage differential can be used to cause electrons to emit from a cathode, impede onto an anode, and generate x-rays. Electrical insulation for isolating this voltage differential can be heavy and expensive. The weight of such electrical insulation can be particularly problematic for portable devices (e.g. portable x-ray sources). The size of the electrical insulation can be a problem if the device needs to be inserted into a small location. It would be desirable to reduce the amount of electrical insulation needed for voltage isolation of large voltages generated by voltage multipliers.

Arcing from or between high-voltage components is a common x-ray source failure. It would be desirable to provide more reliable x-ray sources, less prone to arcing failure.

SUMMARY

It has been recognized that it would be advantageous to reduce the amount of electrical insulation for voltage isolation of large voltages generated by voltage multipliers and to reduce arcing failure. The present invention is directed to various embodiments of x-ray sources that satisfy these needs. Each embodiment may satisfy one, some, or all of these needs. These x-ray sources can be designed for reduced voltage gradient and for more consistent voltage gradient, thus allowing less insulation, reducing arcing failure, or both.

The x-ray source can comprise a bipolar voltage multiplier and an x-ray tube. The bipolar voltage multiplier can include a negative voltage multiplier and a positive voltage multiplier. An axis extending from an input voltage of the negative voltage multiplier to a negative output bias voltage defines a negative axis. An axis extending from an input voltage of the positive voltage multiplier to a positive output bias voltage defines a positive axis. An angle A1 between the negative axis and the positive axis can have the following values: $5° \leq A1 \leq 170°$. A cathode of the x-ray tube can be electrically coupled to the negative output bias voltage and an anode of the x-ray tube can be electrically coupled to the positive output bias voltage.

BRIEF DESCRIPTION OF THE DRAWINGS (DRAWINGS MIGHT NOT BE DRAWN TO SCALE)

Figure 1:
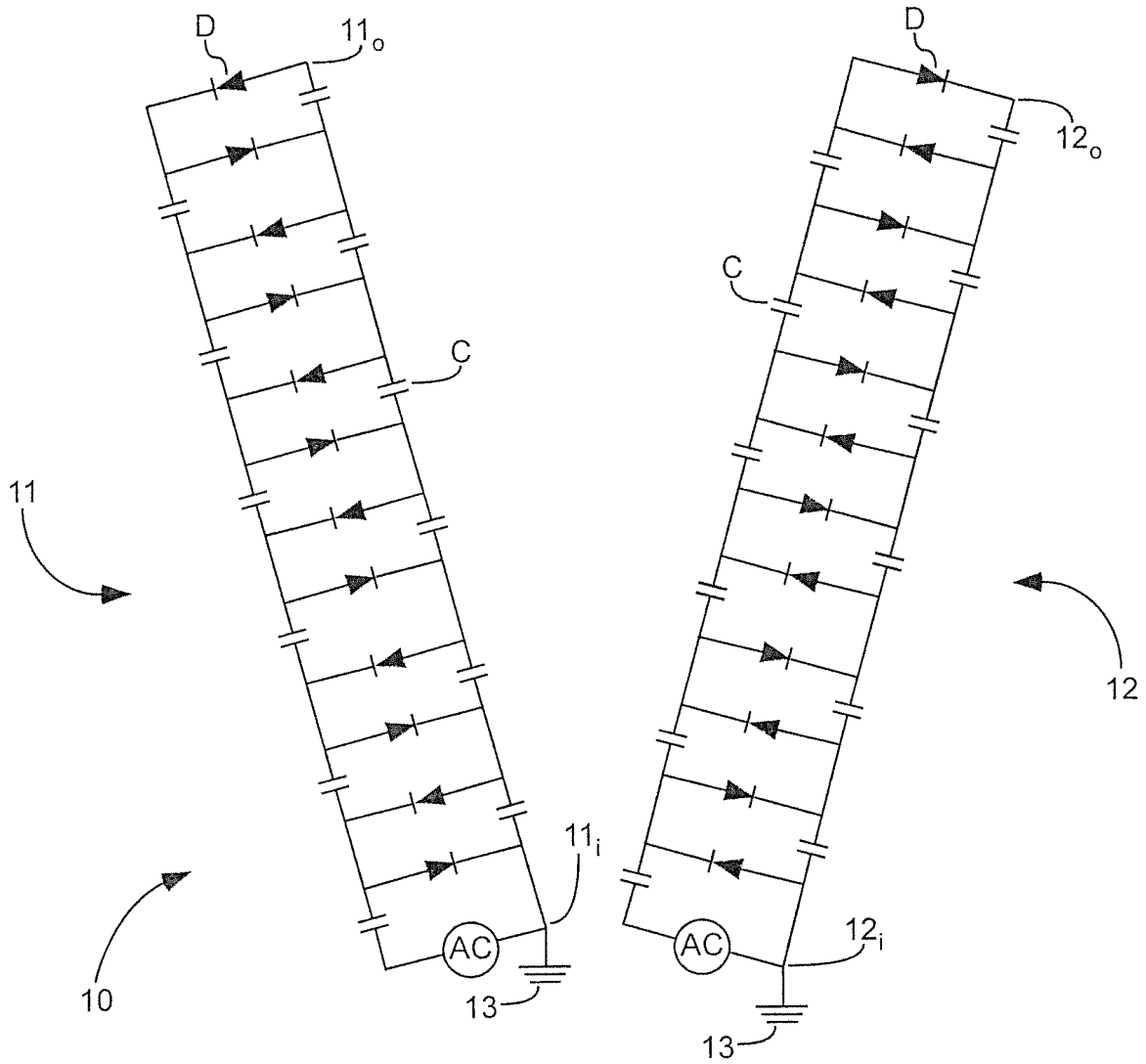

FIG. 1 is a schematic, top-view of a bipolar voltage multiplier 10 with a negative voltage multiplier 11 capable of multiplying an input voltage $\mathbf{11}_i$ to produce a large negative output bias voltage $\mathbf{11}_o$ and a positive voltage multiplier 12 capable of multiplying an input voltage $\mathbf{12}_i$ to produce a large positive output bias voltage $\mathbf{12}_o$, in accordance with an embodiment of the present invention.

Figure 2:
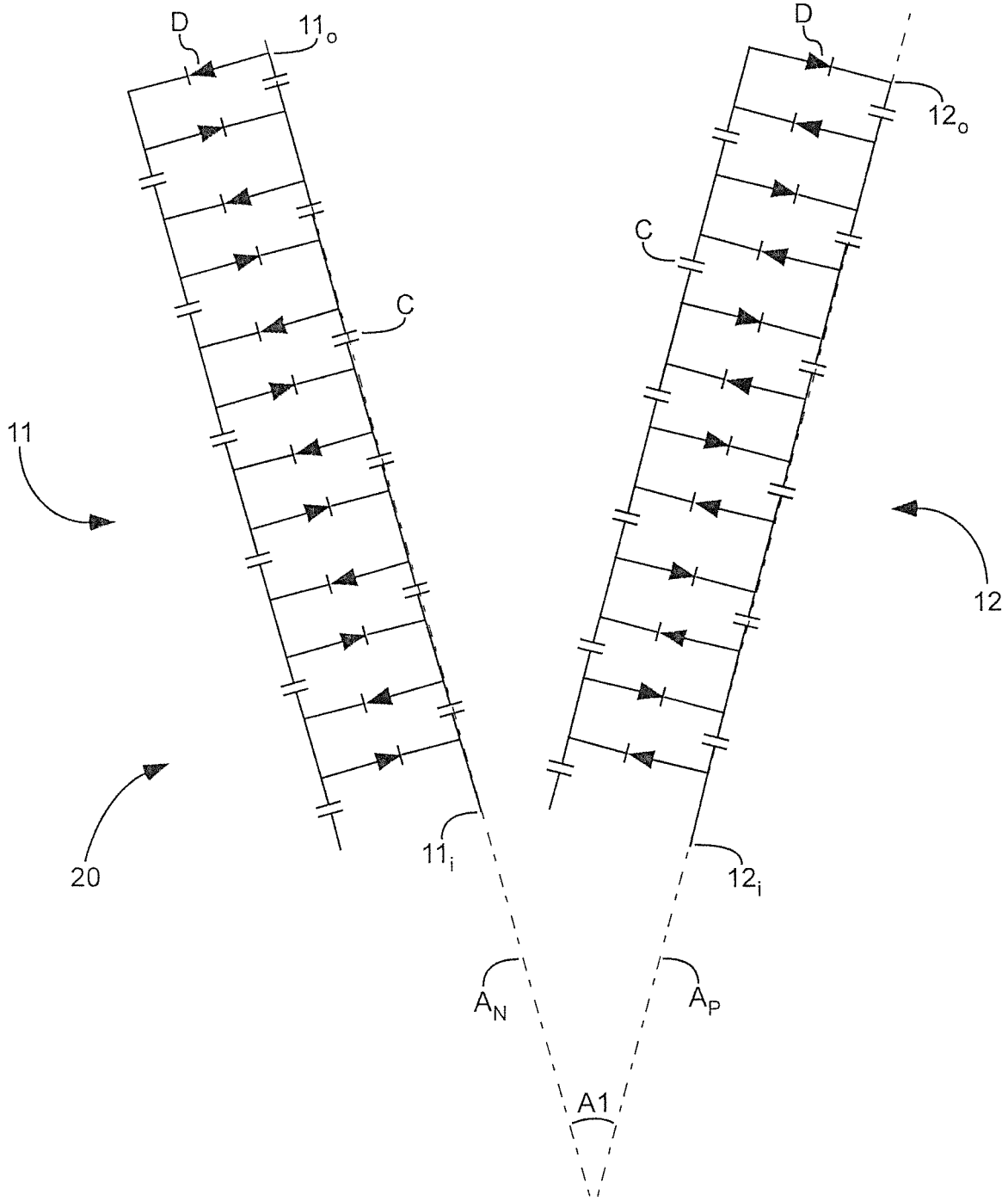

FIG. 2 is a schematic, top-view of a bipolar voltage multiplier 20, similar to bipolar voltage multiplier 10, further illustrating an angle A1 between a negative axis $A_N$ and a positive axis $A_P$, which can be designed for reduced and more consistent voltage gradient, in accordance with an embodiment of the present invention.

Figure 3:
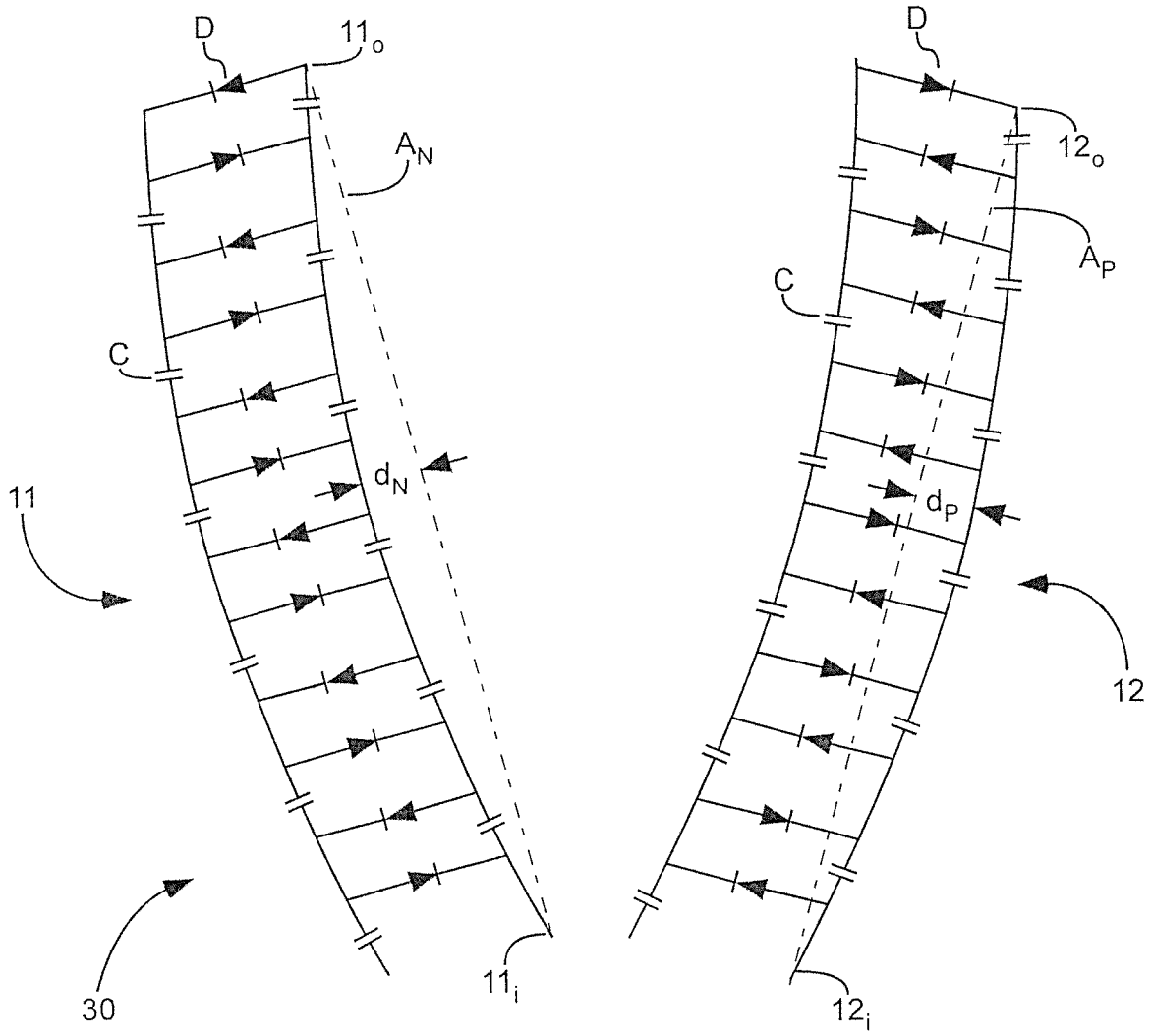

FIG. 3 is a schematic, top-view of a bipolar voltage multiplier 30, similar to bipolar voltage multipliers 10 and 20, further comprising electronic components extending in a curved path, in accordance with an embodiment of the present invention.

Figure 4:
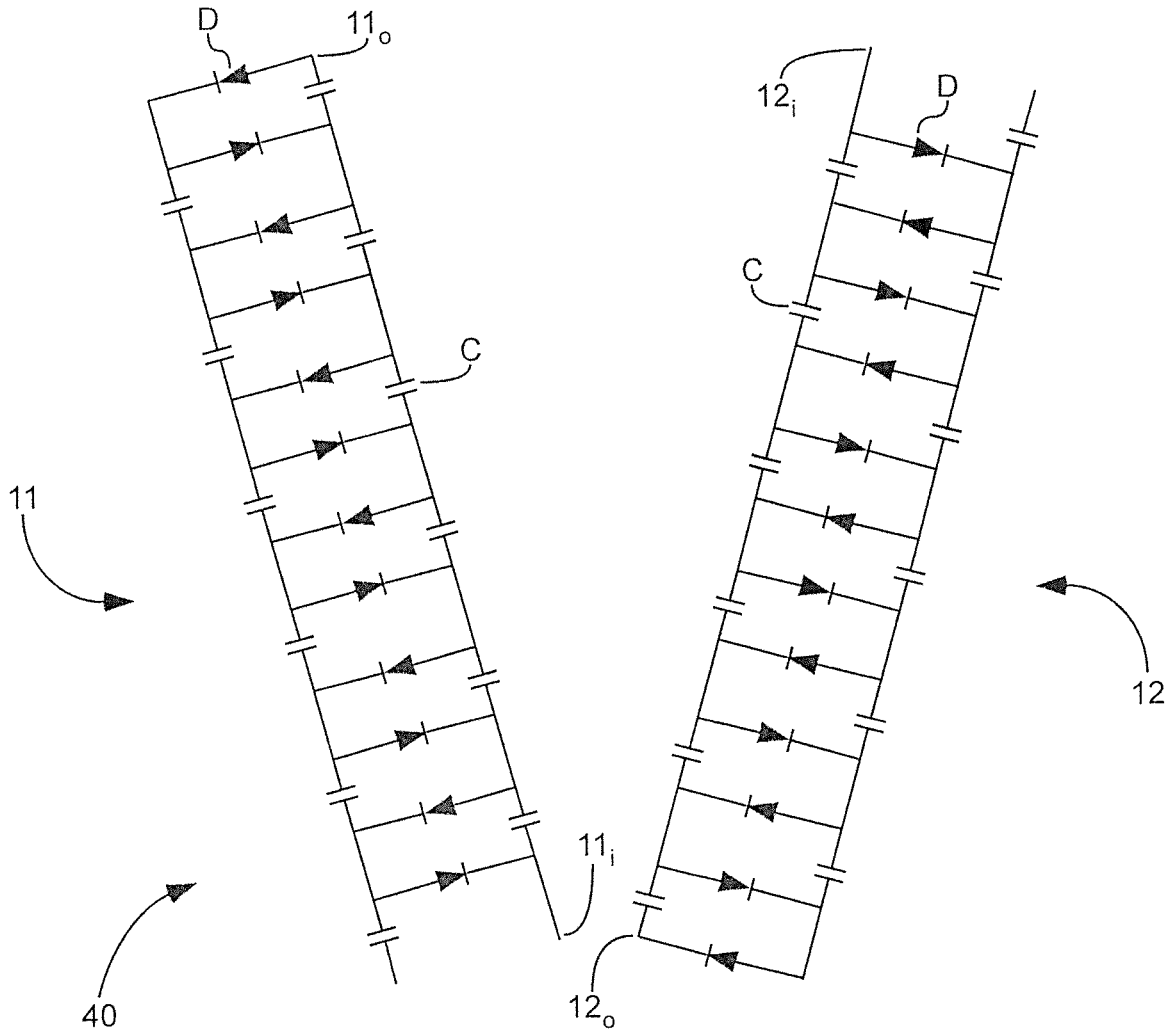
Figure 5:
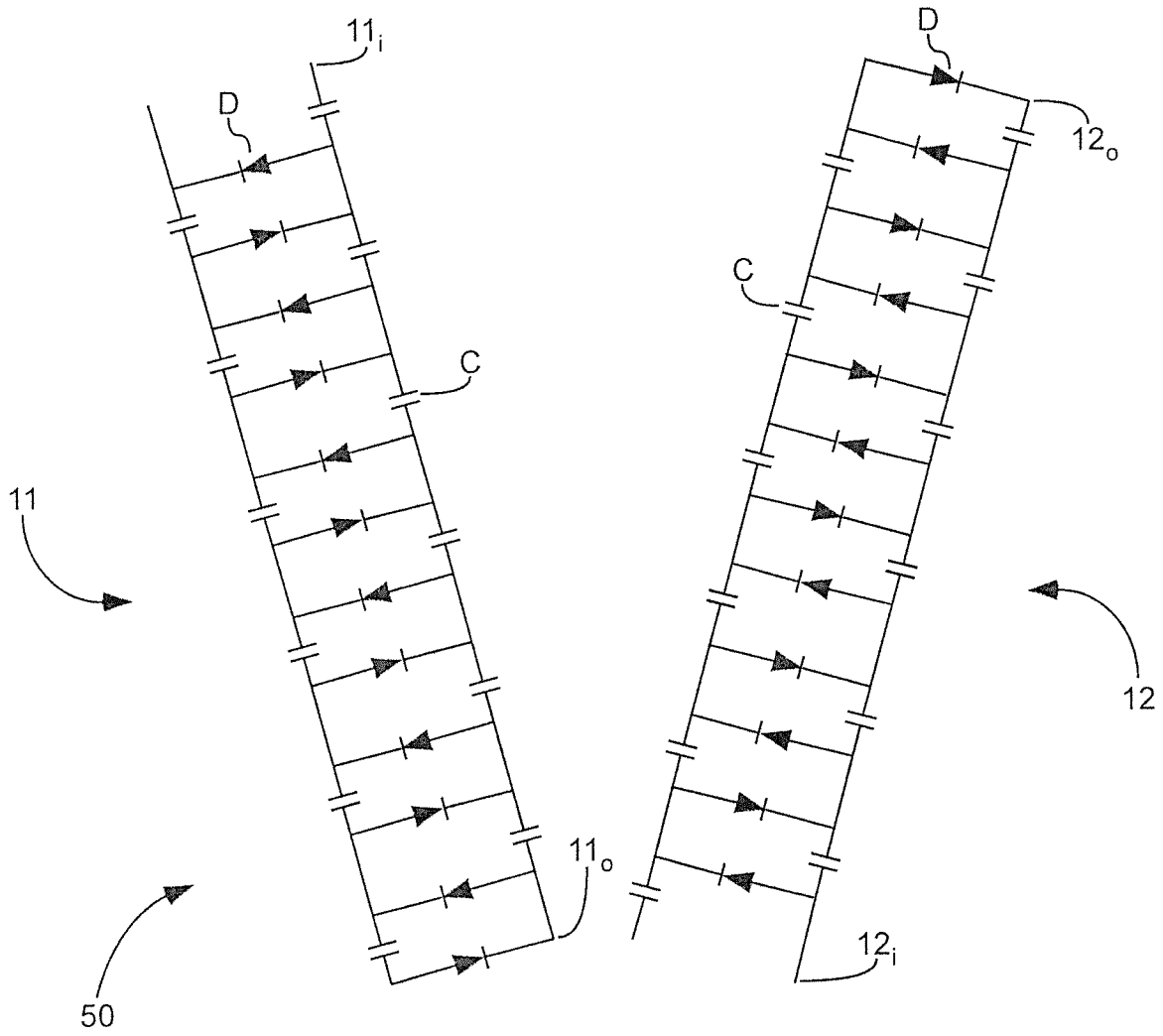

FIGS. 4-5 are schematic, top-views of bipolar voltage multipliers 40 and 50, similar to bipolar voltage multipliers 10, 20, and 30, but a smallest distance between the negative voltage multiplier 11 and the positive voltage multiplier 12 is between the input voltage $\mathbf{11}_i$ or $\mathbf{12}_i$ and the positive output bias voltage $\mathbf{12}_o$ or the negative output bias voltage $\mathbf{11}_o$.

Figure 6:
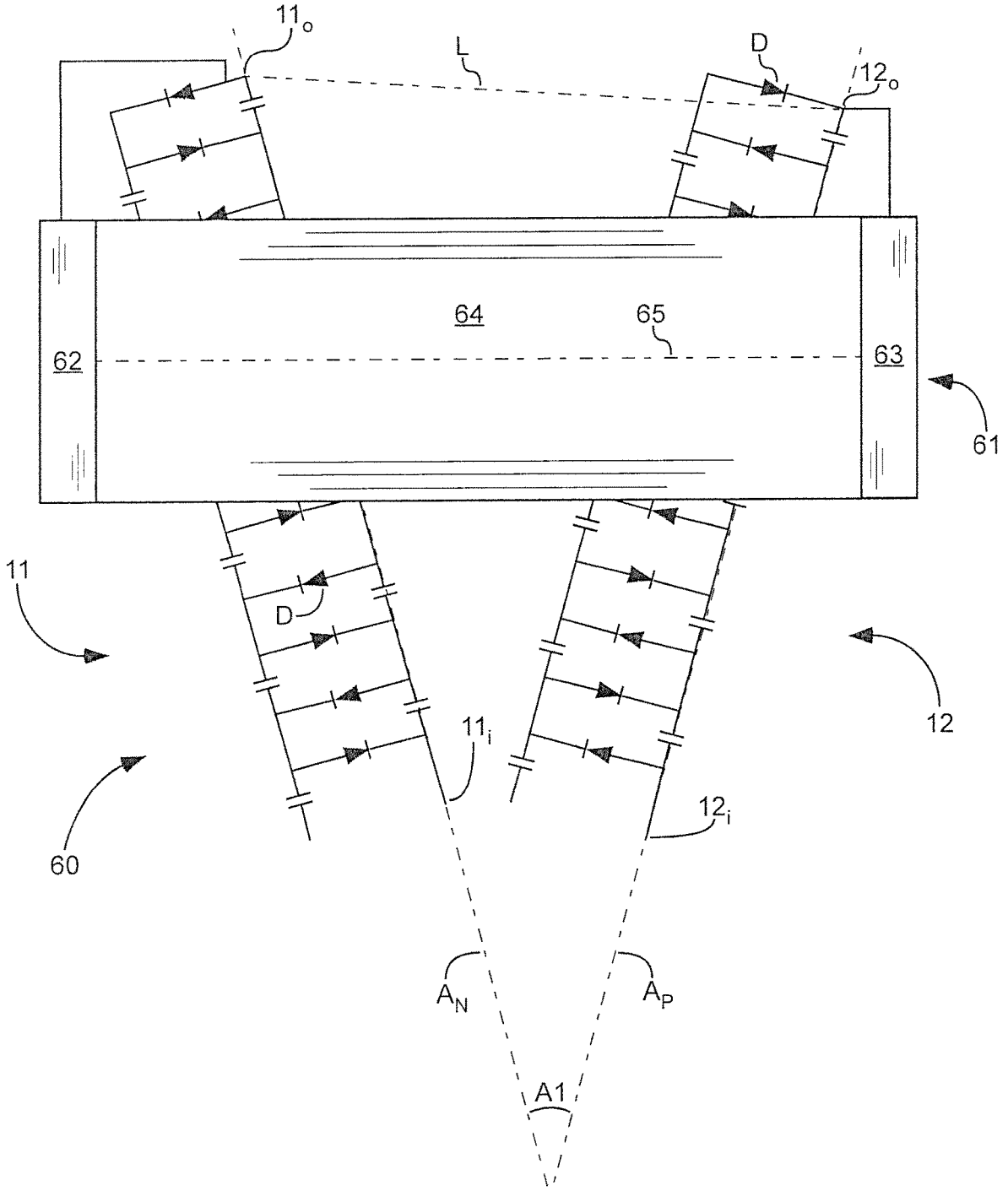

FIG. 6 illustrates an x-ray source 60 with a schematic, cross-sectional side-view of an x-ray tube 61 located over the negative axis $A_N$ and the positive axis $A_P$ of a bipolar voltage multiplier, and an electron beam 65 of the x-ray tube 61 is close to parallel to a line L between the negative output bias voltage $\mathbf{11}_o$ and the positive output bias voltage $\mathbf{12}_o$, in accordance with an embodiment of the present invention.

Figure 7:
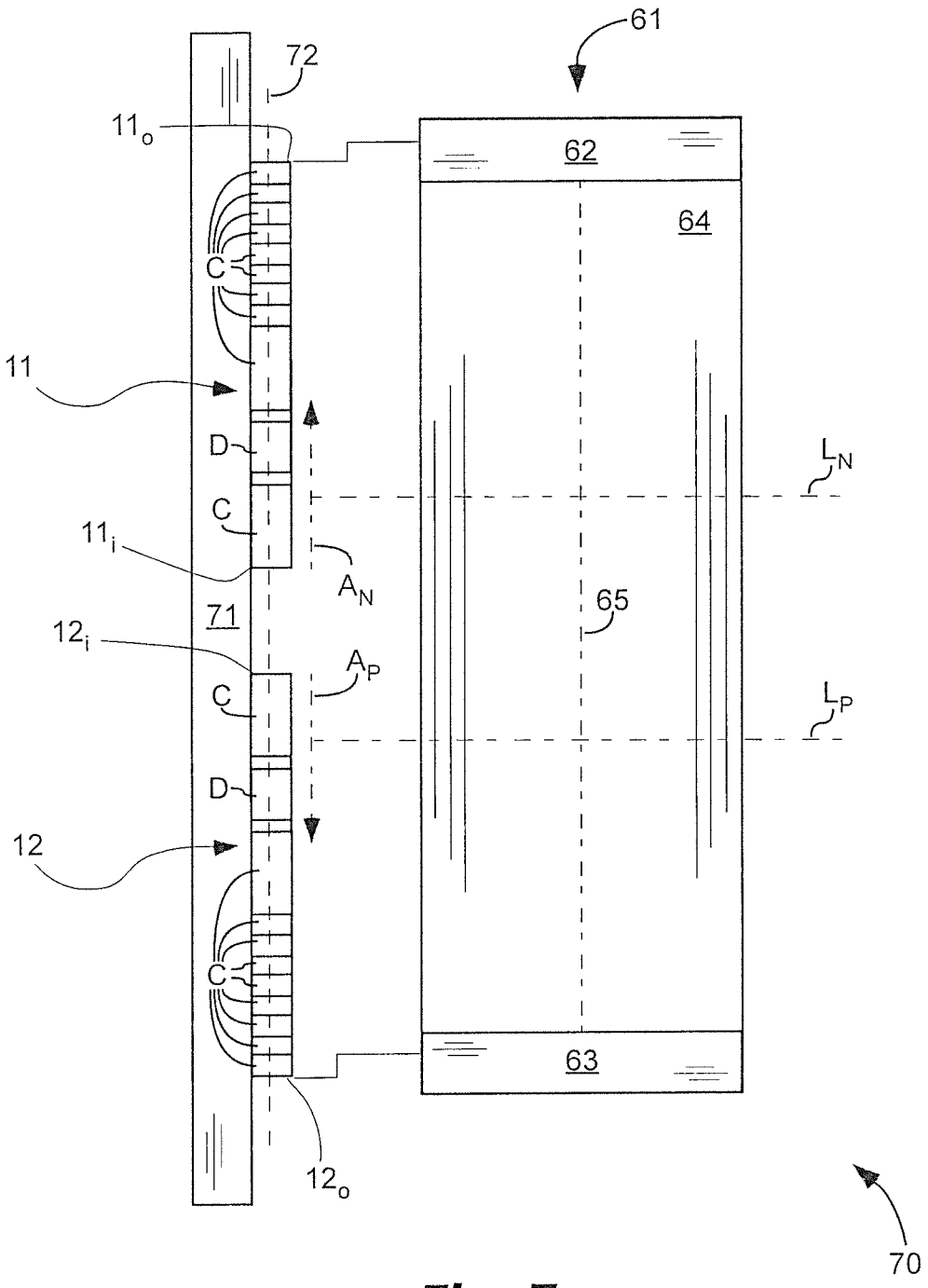

FIG. 7 illustrates an x-ray source 70 with a schematic, cross-sectional side-view of an x-ray tube 61 and an end view of a bipolar voltage multiplier, the negative voltage multiplier 11 and the positive voltage multiplier 12 located on a single circuit board 71, and electronic components of the negative voltage multiplier 11 and of the positive voltage multiplier 12 located in a single plane 72, in accordance with an embodiment of the present invention.

DETAILED DESCRIPTION

As illustrated in FIG. 1, a bipolar voltage multiplier 10 is shown comprising a negative voltage multiplier 11 and a positive voltage multiplier 12. The negative voltage multiplier 11 can multiply an input voltage $\mathbf{11}_i$ (e.g. by an AC source) to produce a large negative output bias voltage $\mathbf{11}_o$, such as for example with a value of ≤−500 V, ≤−1 kV, or ≤−10 kV. The positive voltage multiplier 12 can multiply an input voltage $\mathbf{12}_i$ (e.g. by an AC source) to produce a large positive output bias voltage, such as for example with a value of ≥500 kV, ≥1 kV, or ≥10 kV. In one embodiment, the input voltage $\mathbf{11}_i$ of the negative voltage multiplier 11 and the input voltage $\mathbf{12}_i$ of the positive voltage multiplier 12 can each be connected to ground voltage 13, directly or through a resistor.

As illustrated in FIG. 2, bipolar voltage multiplier 20, similar to bipolar voltage multiplier 10, is shown comprising an axis extending from the input voltage $\mathbf{11}_i$ of the negative voltage multiplier 11 to the negative output bias voltage $\mathbf{11}_o$, defining a negative axis $A_N$, and an axis extending from the input voltage $\mathbf{12}_i$ of the positive voltage multiplier 12 to the positive output bias voltage $\mathbf{12}_o$, defining a positive axis $A_P$. An angle A1 between the negative axis $A_N$ and the positive axis $A_P$ can be designed for reduced voltage gradient and for more consistent voltage gradient, thus allowing less insulation, reducing arcing failure, or both. The optimal angle A1 is dependent on a length of the voltage multipliers 11 and 12, location of an x-ray tube 61 or other high voltage device, type of insulation used, and space constraints. Although optimal angle A1 values can vary according to application, some examples of possibly-effective values for A1 include: 5°≤A1, 10°≤A1, 15°≤A1, or 20°≤A1; and A1≤35°, A1≤40°, A1≤50°, A1≤70°, A1≤90°, A1≤110°, A1≤130°, A1≤150°, or A1≤170°.

As illustrated in FIG. 3, bipolar voltage multiplier 30, similar to bipolar voltage multipliers 10 and 20, includes electronic components (e.g. capacitors C and diodes D) of the negative voltage multiplier 11 extending in a curved path between the input voltage $\mathbf{11}_i$ of the negative voltage multiplier 11 and the negative output bias voltage $\mathbf{11}_o$. Also illustrated on bipolar voltage multiplier 30, electronic components (e.g. capacitors C and diodes D) of the positive voltage multiplier 12 extend in a curved path between the input voltage $\mathbf{12}_i$ of the positive voltage multiplier 12 and the positive output bias voltage $\mathbf{12}_o$. A concave side of the curved path of the negative voltage multiplier 11 and a concave side of the curved path of the positive voltage multiplier 12 can face each other, as shown in FIG. 3. This shape of the bipolar voltage multiplier 30 can reduce voltage gradients and decrease variation in the voltage gradient, thus reducing arcing failure, reduce needed insulation, or both.

A shape or radius of curvature can be selected to optimize the voltage gradient. For example, a distance $d_N$ of the curved path from the negative axis $A_N$ at a mid-point of the negative voltage multiplier 11 can be ≥0.1 cm, ≥0.5 cm, ≥1 cm, or ≥2.5 cm and ≤3.5 cm, ≤5 cm, ≤10 cm, or ≤25 cm. Also, a distance $d_P$ of the curved path from the positive axis $A_P$ at a mid-point of the positive voltage multiplier 12 can be ≥0.1 cm, ≥0.5 cm, ≥1 cm, or ≥2.5 cm and ≤3.5 cm, ≤5 cm, ≤10 cm, or ≤25 cm.

By proper selection of angle A1; and possible curvature of the negative voltage multiplier 11, the positive voltage multiplier 12, or both; a maximum voltage gradient of the bipolar voltage multiplier can be reduced. For example, for the various embodiments described herein, a maximum voltage gradient between the negative voltage multiplier 11 and the positive voltage multiplier 12 can be ≥500 volts/millimeter and ≤3000 volts/millimeter, ≤4000 volts/millimeter, ≤5000 volts/millimeter, ≤6000 volts/millimeter, ≤7000 volts/millimeter, ≤8000 volts/millimeter, or ≤9000 volts/millimeter.

As illustrated in FIGS. 1-3 and 6, a smallest distance between the negative voltage multiplier 11 and the positive voltage multiplier 12 can be between the input voltage $\mathbf{11}_i$ of the negative voltage multiplier 11 and the input voltage $\mathbf{12}_i$ of the positive voltage multiplier 12. As illustrated in FIG. 4, a smallest distance between the negative voltage multiplier 11 and the positive voltage multiplier 12 can be between the input voltage $\mathbf{11}_i$ of the negative voltage multiplier 11 and the positive output bias voltage $\mathbf{12}_o$. As illustrated in FIG. 5, a smallest distance between the negative voltage multiplier 11 and the positive voltage multiplier 12 can be between the negative output bias voltage $\mathbf{11}_o$ and the input voltage $\mathbf{12}_i$ of the positive voltage multiplier 12. A choice between these different embodiments can be made based on space constraints, arrangement of the x-ray tube 61 or other high voltage device, and type of insulation used.

As illustrated in FIGS. 6-7, x-ray sources 60 and 70 can include a bipolar voltage multiplier, according to an embodiment described herein, and an x-ray tube 61. The x-ray tube 61 can include a cathode 62 and an anode 63 electrically insulated from one another, such as by electrically-insulative cylinder 64. The cathode 62 can be configured to emit electrons towards the anode 63. The anode 63 can be configured to emit x-rays out of the x-ray tube 61 in response to impinging electrons from the cathode 62. The cathode 62 can be electrically coupled to the negative output bias voltage $\mathbf{11}_o$ and the anode 63 can be electrically coupled to the positive output bias voltage $\mathbf{12}_o$.

One or more of the following embodiments, illustrated in FIGS. 6-7, can be selected for improved voltage gradients. The cathode 62 can be closer to the negative output bias voltage $\mathbf{11}_o$ than to the positive output bias voltage $\mathbf{12}_o$. The anode 63 can be closer to the positive output bias voltage $\mathbf{12}_o$ than to the negative output bias voltage $\mathbf{11}_o$. A center of a path of the electrons, defining an electron beam 65, can be parallel to, or close to parallel to, a line L between the negative output bias voltage $\mathbf{11}_o$ and the positive output bias voltage $\mathbf{12}_o$. For example, the line L can be within 1°, within 5°, within 10°, within 20°, within 30°, or within 40°, of parallel to the electron beam 65. The x-ray tube 61 can be located over the negative axis $A_N$ and the positive axis $A_P$ such that a line $L_N$ perpendicular to the negative axis $A_N$ and a line $L_P$ perpendicular to the positive axis $A_P$ each pass through the x-ray tube 61.

The negative voltage multiplier 11 and the positive voltage multiplier 12 can be located on separate circuit boards. Alternatively, as illustrated in FIG. 7, the negative voltage multiplier 11 and the positive voltage multiplier 12 can be located on a single circuit board 71. This single circuit board 71 can be a single, solid, integral board. A choice between these options can be based on manufacturability, size constraints, and cost.

For reduced manufacturing cost, electronic components of the negative voltage multiplier 11 and of the positive voltage multiplier 12 can be located in a single plane 72. For example, there can be ≥80%, ≥90%, ≥95%, or all such electronic components in this single plane 72.

What is claimed is:

1. An x-ray source comprising:

a bipolar voltage multiplier including:

a negative voltage multiplier configured to multiply an input voltage to produce a negative output bias voltage having a value of ≤−1 kV;

a positive voltage multiplier configured to multiply an input voltage to produce a positive output bias voltage having a value of ≥1 kV;

an axis extending from the input voltage of the negative voltage multiplier to the negative output bias voltage, defining a negative axis;

an axis extending from the input voltage of the positive voltage multiplier to the positive output bias voltage, defining a positive axis;

10°≤A1≤50°, where A1 is an angle between the negative axis and the positive axis;

the negative voltage multiplier and the positive voltage multiplier are located on a single circuit board; and ≥95% of electronic components of the negative voltage multiplier and ≥95% of electronic components of the positive voltage multiplier are located in a single plane;

an x-ray tube including a cathode and an anode electrically insulated from one another, the cathode configured to emit electrons towards the anode, and the anode configured to emit x-rays out of the x-ray tube in response to impinging electrons from the cathode; and the cathode electrically coupled to the negative output bias voltage and the anode electrically coupled to the positive output bias voltage.

2. The x-ray source of claim 1, wherein:

the cathode is closer to the negative output bias voltage than to the positive output bias voltage and the anode is closer to the positive output bias voltage than to the negative output bias voltage; and a center of a path of the electrons, defining an electron beam, is within 30° of parallel to a line between the negative output bias voltage and the positive output bias voltage.

3. The x-ray source of claim 2, wherein the x-ray tube is located over the negative axis and the positive axis such that a line perpendicular to the negative axis and a line perpendicular to the positive axis each pass through the x-ray tube.

4. The x-ray source of claim 1, wherein:

the electronic components of the negative voltage multiplier extend in a curved path between the input voltage of the negative voltage multiplier and the negative output bias voltage;

the electronic components of the positive voltage multiplier extend in a curved path between the input voltage of the positive voltage multiplier and the positive output bias voltage; and a concave side of the curved path of the negative voltage multiplier and a concave side of the curved path of the positive voltage multiplier face each other.

5. The x-ray source of claim 4, wherein:

a distance of the curved path from the negative axis at a mid-point of the negative voltage multiplier is ≥0.5 cm and ≤5 cm; and a distance of the curved path from the positive axis at a mid-point of the positive voltage multiplier is ≥0.5 cm and ≤5 cm.

6. The x-ray source of claim 1, wherein a maximum voltage gradient between the negative voltage multiplier and the positive voltage multiplier is ≤6000 volts/millimeter.

7. An x-ray source comprising:

a bipolar voltage multiplier including:

a negative voltage multiplier configured to multiply an input voltage to produce a negative output bias voltage having a value of ≤−1 kV;

a positive voltage multiplier configured to multiply an input voltage to produce a positive output bias voltage having a value of ≥1 kV;

a smallest distance between the negative voltage multiplier and the positive voltage multiplier is at the input voltage ends of the voltage multipliers;

an axis extending from the input voltage of the negative voltage multiplier to the negative output bias voltage, defining a negative axis;

an axis extending from the input voltage of the positive voltage multiplier to the positive output bias voltage, defining a positive axis; and 10°≤A1≤170°, where A1 is an angle between the negative axis and the positive axis;

an x-ray tube including a cathode and an anode electrically insulated from one another, the cathode configured to emit electrons towards the anode, and the anode configured to emit x-rays out of the x-ray tube in response to impinging electrons from the cathode;

the cathode electrically coupled to the negative output bias voltage and the anode electrically coupled to the positive output bias voltage;

the cathode is closer to the negative output bias voltage than to the positive output bias voltage and the anode is closer to the positive output bias voltage than to the negative output bias voltage; and a center of a path of the electrons, defining an electron beam, is within 30° of parallel to a line between the negative output bias voltage and the positive output bias voltage.

8. The x-ray source of claim 7, wherein:

electronic components of the negative voltage multiplier extend in a curved path between the input voltage of the negative voltage multiplier and the negative output bias voltage;

electronic components of the positive voltage multiplier extend in a curved path between the input voltage of the positive voltage multiplier and the positive output bias voltage;

a concave side of the curved path of the negative voltage multiplier and a concave side of the curved path of the positive voltage multiplier face each other;

a distance of the curved path from the negative axis at a mid-point of the negative voltage multiplier is ≥0.5 cm and ≤5 cm; and a distance of the curved path from the positive axis at a mid-point of the positive voltage multiplier is ≥0.5 cm and ≤5 cm.

9. An x-ray source comprising:

a bipolar voltage multiplier including:

a negative voltage multiplier configured to multiply an input voltage to produce a negative output bias voltage having a value of ≤−1 kV;

a positive voltage multiplier configured to multiply an input voltage to produce a positive output bias voltage having a value of ≥1 kV;

an axis extending from the input voltage of the negative voltage multiplier to the negative output bias voltage, defining a negative axis;

an axis extending from the input voltage of the positive voltage multiplier to the positive output bias voltage, defining a positive axis; and 10°≤A1≤170°, where A1 is an angle between the negative axis and the positive axis;

an x-ray tube including a cathode and an anode electrically insulated from one another, the cathode configured to emit electrons towards the anode, and the anode configured to emit x-rays out of the x-ray tube in response to impinging electrons from the cathode; and the cathode electrically coupled to the negative output bias voltage and the anode electrically coupled to the positive output bias voltage.

10. The x-ray source of claim 9, wherein:

the cathode is closer to the negative output bias voltage than to the positive output bias voltage and the anode is closer to the positive output bias voltage than to the negative output bias voltage; and a center of a path of the electrons, defining an electron beam, is within 30° of parallel to a line between the negative output bias voltage and the positive output bias voltage.

11. The x-ray source of claim 10, wherein the x-ray tube is located over the negative axis and the positive axis such that a line perpendicular to the negative axis and a line perpendicular to the positive axis each pass through the x-ray tube.

12. The x-ray source of claim 9, wherein:

electronic components of the negative voltage multiplier extend in a curved path between the input voltage of the negative voltage multiplier and the negative output bias voltage;

electronic components of the positive voltage multiplier extend in a curved path between the input voltage of the positive voltage multiplier and the positive output bias voltage;

a concave side of the curved path of the negative voltage multiplier and a concave side of the curved path of the positive voltage multiplier face each other.

13. The x-ray source of claim 12, wherein:

a distance of the curved path from the negative axis at a mid-point of the negative voltage multiplier is ≥0.5 cm and ≤5 cm; and a distance of the curved path from the positive axis at a mid-point of the positive voltage multiplier is ≥0.5 cm and ≤5 cm.

14. The x-ray source of claim 9, wherein a smallest distance between the negative voltage multiplier and the positive voltage multiplier is between the input voltage of the negative voltage multiplier and the input voltage of the positive voltage multiplier.

15. The x-ray source of claim 9, wherein the input voltage of the negative voltage multiplier and the input voltage of the positive voltage multiplier are both connected to ground voltage.

16. The x-ray source of claim 9, wherein 15°≤A1≤40°.

17. The x-ray source of claim 9, wherein a maximum voltage gradient between the negative voltage multiplier and the positive voltage multiplier is ≤6000 volts/millimeter.

18. The x-ray source of claim 9, wherein a maximum voltage gradient between the negative voltage multiplier and the positive voltage multiplier is ≤9000 volts/millimeter.

19. The x-ray source of claim 9, wherein the negative voltage multiplier and the positive voltage multiplier are located on a single circuit board.

20. The x-ray source of claim 9, wherein ≥95% of electronic components of the negative voltage multiplier and ≥95% of electronic components of the positive voltage multiplier are located in a single plane.

* * * * *